US006446450B1

(12) United States Patent
Pressler

(10) Patent No.: US 6,446,450 B1
(45) Date of Patent: Sep. 10, 2002

(54) REFRIGERATION SYSTEM WITH LIQUID TEMPERATURE CONTROL

(75) Inventor: Kevin T. Pressler, Rochester, NY (US)

(73) Assignee: Firstenergy Facilities Services, Group, LLC, Akron, OH (US)

( * ) Notice: Subject to any disclaimer, the term of this patent is extended or adjusted under 35 U.S.C. 154(b) by 15 days.

(21) Appl. No.: 09/675,222

(22) Filed: Sep. 29, 2000

Related U.S. Application Data

(60) Provisional application No. 60/157,330, filed on Oct. 1, 1999.

(51) Int. Cl.[7] ..... F25B 41/04

(52) U.S. Cl. ..... 62/217; 62/150; 62/176.1; 62/197; 62/211

(58) Field of Search ..... 62/217, 150, 176.1, 62/176.6, 197, 209, 210, 211, 212

(56) References Cited

U.S. PATENT DOCUMENTS 4,696,168 A * 9/1987 Woods et al. ..... 62/200
4,986,084 A * 1/1991 Beckhausen ..... 62/197
5,056,329 A * 10/1991 Wilkinson ..... 62/197
5,622,057 A * 4/1997 Bussjager et al. ..... 62/173
5,711,161 A * 1/1998 Gustafson ..... 62/197
6,167,722 B1 * 1/2001 Kasezawa et al. ..... 62/513
6,202,438 B1 * 3/2001 Barito ..... 62/513

* cited by examiner

*Primary Examiner*—Denise L. Esquivel
*Assistant Examiner*—Marc Norman
(74) *Attorney, Agent, or Firm*—Fay, Sharpe, Fagan, Minnich & McKee, LLP

(57) ABSTRACT

An improved refrigeration system utilizing a subcooler/economizer is provided. The refrigeration system comprises a compressor, a condenser, a refrigeration case, and an evaporator for cooling the refrigeration case. The refrigeration system may further include a subcooler. A modulating evaporator pressure regulator valve is located downstream of the evaporator, on the return line between the subcooler and the compressor. The valve controls the suction gas pressure of the compressor which, in turn, controls the liquid temperature of the refrigerant entering the evaporators. The modulation of the pressure regulator valve is dependent on the dew point of the store and/or the temperature of the liquid entering the evaporators.

14 Claims, 2 Drawing Sheets

REFRIGERATION SYSTEM WITH LIQUID TEMPERATURE CONTROL

This application claims the benefit of U.S. Provisional Application Ser. No. 60/157,330, filed on Oct. 1, 1999.

BACKGROUND OF THE INVENTION

1. Field of the Invention

The present invention relates to refrigeration and air conditioning systems, and more particularly, to an improved system utilizing a modulating valve in conjunction with a subcooler/economizer for controlling the temperature of a refrigerant in the system. The present invention finds particular application in conjunction with supermarket food refrigeration systems, and it will be described with particular reference thereto. However, it is to be appreciated that the present invention is also amenable to other like applications.

2. Discussion of the Art

Commercial refrigeration and air conditioning systems frequently employ multiple evaporators to meet specific cooling needs. Often the evaporators and their associated expansion valves are remotely located relative to other components of the refrigeration system in order to cool refrigeration cases. As a result, lines, conduits, or piping leading to the remotely located evaporators cover great distances and decrease the overall efficiency of the refrigeration system. With the increasingly high cost of energy, it is generally desirable to increase the efficiency of commercial refrigeration systems.

One method of combating the inefficiencies associated with remotely located refrigeration cases is to use subcooling. Subcooling the liquid refrigerant of a refrigeration system increases the refrigerant effect, or the quantity of heat absorbed in the refrigerated space per unit mass, without increasing energy input to the compressors. Thus, subcooling increases the efficiency of the system and reduces the power requirements of the system per unit of refrigerating capacity.

Even with subcooling, inefficiencies may still exist. For example, pipes running from the condenser to the evaporators are often not insulated due to the remote location of the evaporators. As a result the refrigerant flowing through these pipes is often below the dew point and causes sweating or condensation of water on the pipes. As is well known, sweating decreases the efficiency rating of the refrigeration system.

Therefore, it is desirable to provide an improved refrigeration system with controlled subcooling for overcoming these problems and others.

BRIEF SUMMARY OF THE INVENTION

The present invention relates to an improved refrigeration system utilizing a modulating valve in conjunction with a subcooler/economizer for controlling the temperature of a refrigerant in the system.

In accordance with one aspect of the present invention, the refrigeration system comprises a compressor, a condenser, one or more refrigeration cases, and an evaporator for cooling the refrigeration cases. The compressor is interconnected to the condenser, the condenser is interconnected to the evaporator, and the evaporator is interconnected to the compressor in a closed loop.

The refrigeration system further includes a subcooler operatively disposed downstream of the condenser and upstream of the evaporator. The subcooler includes an expansion valve for expanding a first portion of the condensed refrigerant exiting the condenser and using the expanded refrigerant for subcooling a second portion of remaining unexpanded refrigerant exiting the condenser. The unexpanded refrigerant flows to the evaporator after subcooling. The subcooler also has a return line in parallel with the evaporator for returning the expanded refrigerant to the compressor after subcooling.

A modulating evaporator pressure regulator valve is located on the return line. The modulating valve controls a suction gas pressure to the compressor which controls the liquid temperature of the refrigerant entering the evaporators. The modulation of the valve occurs in response to a dew point in the ambient environment or store and/or the temperature of the liquid entering the evaporators which efficiently cools the refrigeration cases to a desired temperature while preventing line sweating.

In accordance with another aspect of the present invention, the modulating valve modulates in response to the ambient temperature in the store.

In accordance with another aspect of the present invention, the modulating valve modulates in response to the temperature of the expanded refrigerant entering the subcooler.

In accordance with another aspect of the present invention, the subcooler is removed.

A primary advantage of the present invention is the provision of a refrigeration system that allows for a smaller compressor without reducing the refrigeration capacity of the system.

Another advantage of the present invention is the provision of a refrigeration system that can be operated remotely.

A further advantage of the present invention is the provision of a refrigeration system that allows for smaller, less expensive refrigeration lines.

Another advantage of the present invention is the provision of a refrigeration system that does not require insulated lines, yet limits sweating of the lines.

Still another advantage of the present invention is the provision of a refrigeration system that requires less refrigerant in the system.

Further advantages and benefits of the present invention will become apparent to those skilled in the art upon reading and understanding the following detailed description.

BRIEF DESCRIPTION OF THE DRAWINGS

The structure, operation and advantages of presently preferred embodiments of this invention will become further apparent upon consideration of the following description, taken in conjunction with the accompanying drawings. Of course, the drawings are only for purposes of illustrating preferred embodiments and are not to be construed as limiting the invention.

DETAILED DESCRIPTION OF THE INVENTION

Figure 1:
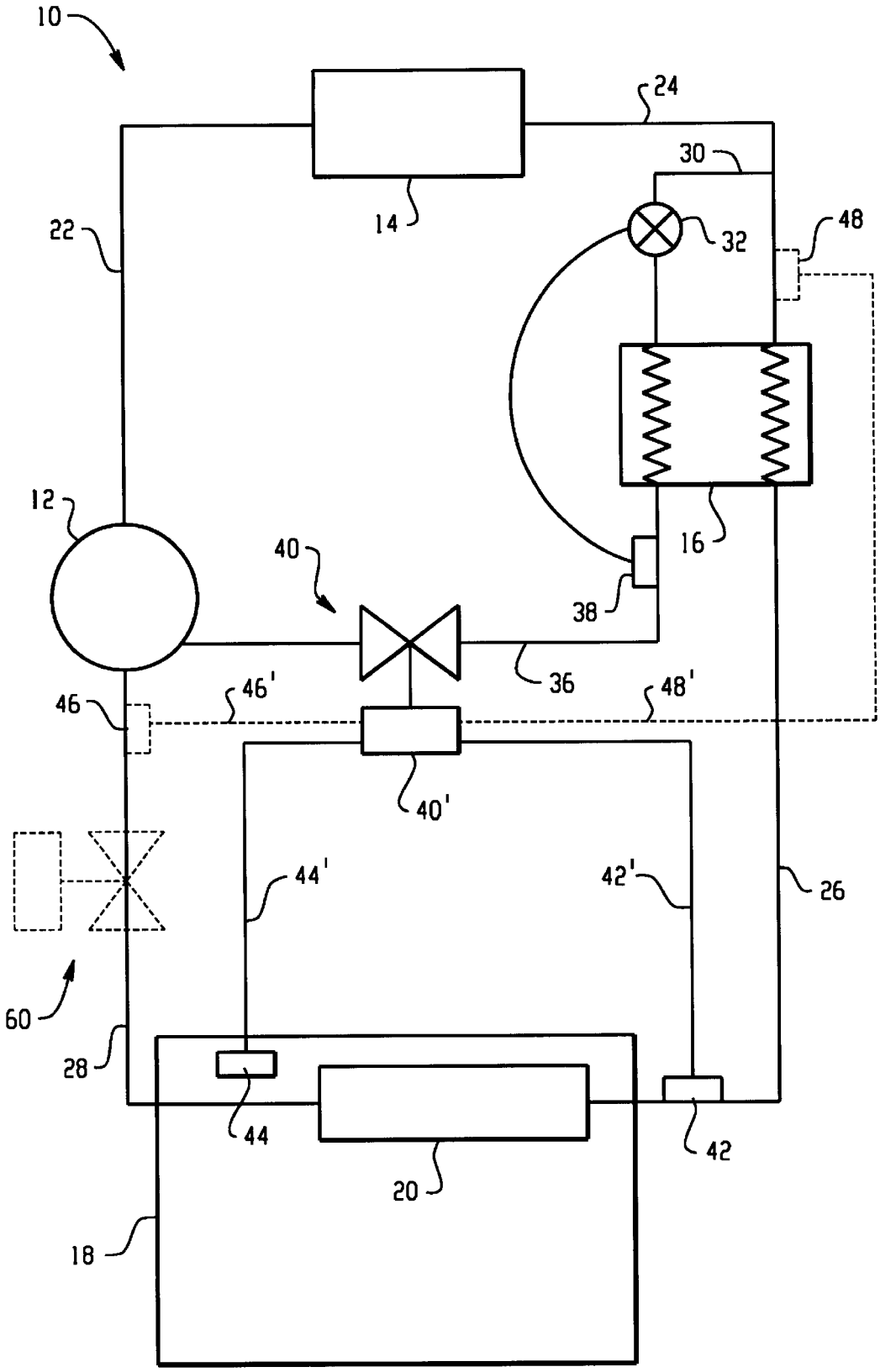
FIG. 1 is a schematic diagram of a refrigeration system having a subcooler in accordance with the present invention.

With reference to FIG. 1, a refrigeration system according to a preferred embodiment of the present invention is generally indicated by reference numeral 10. The refrigeration system 10 comprises a compressor 12, a condenser 14, a subcooler 16, one or more refrigeration cases 18, and an evaporator 20 for cooling the refrigeration cases 18.

The refrigerant output of the compressor 12 flows via line, passage, conduit, or piping 22 to the condenser 14, the refrigerant output of the condenser 14 flows via line 24 to the subcooler 16, the refrigerant output of the subcooler 16 generally flows via line 26 to the evaporator 20, and the refrigerant output of the evaporator 20 flows via line 28 to the compressor 12. The line 26 flowing to the evaporator 20 is often lengthy and not insulated allowing remote placement of the evaporator 20 and the refrigeration cases 18 relative to the remaining components of the refrigeration system.

A portion of the refrigerant flowing through line 24 is diverted by bleed line 30. An expansion valve 32 is disposed in bleed line 30 for expanding the portion of refrigerant passing therethrough. The expanded refrigerant is used to subcool the remaining refrigerant flowing through the subcooler 16 and into the evaporator 20 via line 26. A return line 36, in parallel with the evaporator 20, is used for returning the expanded refrigerant to the compressor 12 after subcooling. The expansion valve 32 operates in response to the temperature of the expanded refrigerant exiting the subcooler 16 in the return line 36 as measured by return line sensor 38.

A modulating evaporator pressure regulator valve 40 is disposed in return line 36. The modulating valve 40 selectively controls return suction gas pressure to the compressor 12 and thereby controls the liquid temperature of the refrigerant entering the evaporator 20. More specifically, the modulating valve 40 modulates the flow of refrigerant therethrough. Modulation occurs via valve controller 40', in response to the dew point of the store, or ambient environment that surrounds the line 26, as measured by sensor 42, and/or the temperature of the liquid refrigerant entering the evaporator 20, as measured by evaporator inlet sensor 44. Modulating the flow of refrigerant allows the system 10 to efficiently cool the refrigeration cases 18 to a desired temperature while preventing line sweating in line 26 connected to the evaporator 20.

In order to prevent line sweating in a refrigeration system, the temperature of the liquid refrigerant running through the line 26 to the evaporator 20 must be kept above the dew point temperature in the store. When the dew point temperature is high as a result of high humidity, the temperature of the liquid refrigerant must be kept relatively high to prevent line sweating. In prior art systems, the temperature of the liquid refrigerant was constant and, therefore, had to be set for a high dew point in order to prevent line sweating under high humidity. As a result, the prior art refrigeration systems avoided line sweating but were inefficient on lower humidity days, or undesirable sweating occurred on higher humidity days. Ideally, the temperature of the liquid refrigerant should be as low as possible without dipping below the dew point temperature.

The modulating valve 40 of the present invention operates to adjust the temperature of the liquid refrigerant entering the evaporator 20. When the humidity is relatively high, the controller 40' throttles toward a closed position which causes the temperature of the liquid refrigerant to rise and stay above the dew point. When the humidity is relatively low, the modulating valve is throttled toward an open position allowing for maximum subcooling and causing the temperature of the liquid refrigerant to lower. Under these operating conditions, the system 10 advantageously prevents line sweating and runs more efficiently.

Besides the system described above, the modulating valve 40 is capable of operating in response to various types of sensors in different locations of the refrigerant system. For instance, the modulating valve controller can also respond to the temperature in the refrigeration cases 18. In this alternative, the refrigeration case sensor 42 monitors the temperature in the refrigeration cases and provides feedback data or information via line 42' to the valve controller 40' so that the valve is modulated in response thereto.

In another alternative, the valve controller can also receive a signal relating to the temperature of the refrigerant returning to the compressor via the line 28, as measured by sensor 46. A feedback signal is provided to the controller 40' as indicated by line 46'. In yet another alternative, the temperature of the refrigerant entering the subcooler 16, as measured by a subcooler sensor 48, is conveyed to the controller 40' through line 48' to modulate the valve. It is to be appreciated that the valve 40 can modulate in response to a combination of measurements taken by the above disclosed sensors 42–48, however, the present invention uses the information from sensor 42 to control the modulating valve, and may also use additional data from one or more of the sensors 44, 46, and 48. The number of sensors used and the location of the sensors may vary. All such combinations and locations are to be considered within the scope of the present invention.

The location of the modulating valve 40 in the system 10 may also be varied. For example, the modulating valve 60 can be positioned in the line 28 between the evaporator 20 and the compressor 12. The modulating valve 40 or 60 continues to selectively control the suction gas pressure to the compressor 12 thereby controlling the liquid temperature of the refrigerant entering the evaporator 20. The sensors are used in generally the same manner as described above to provide feedback/response signals to the modulating valve controller.

Figure 2:
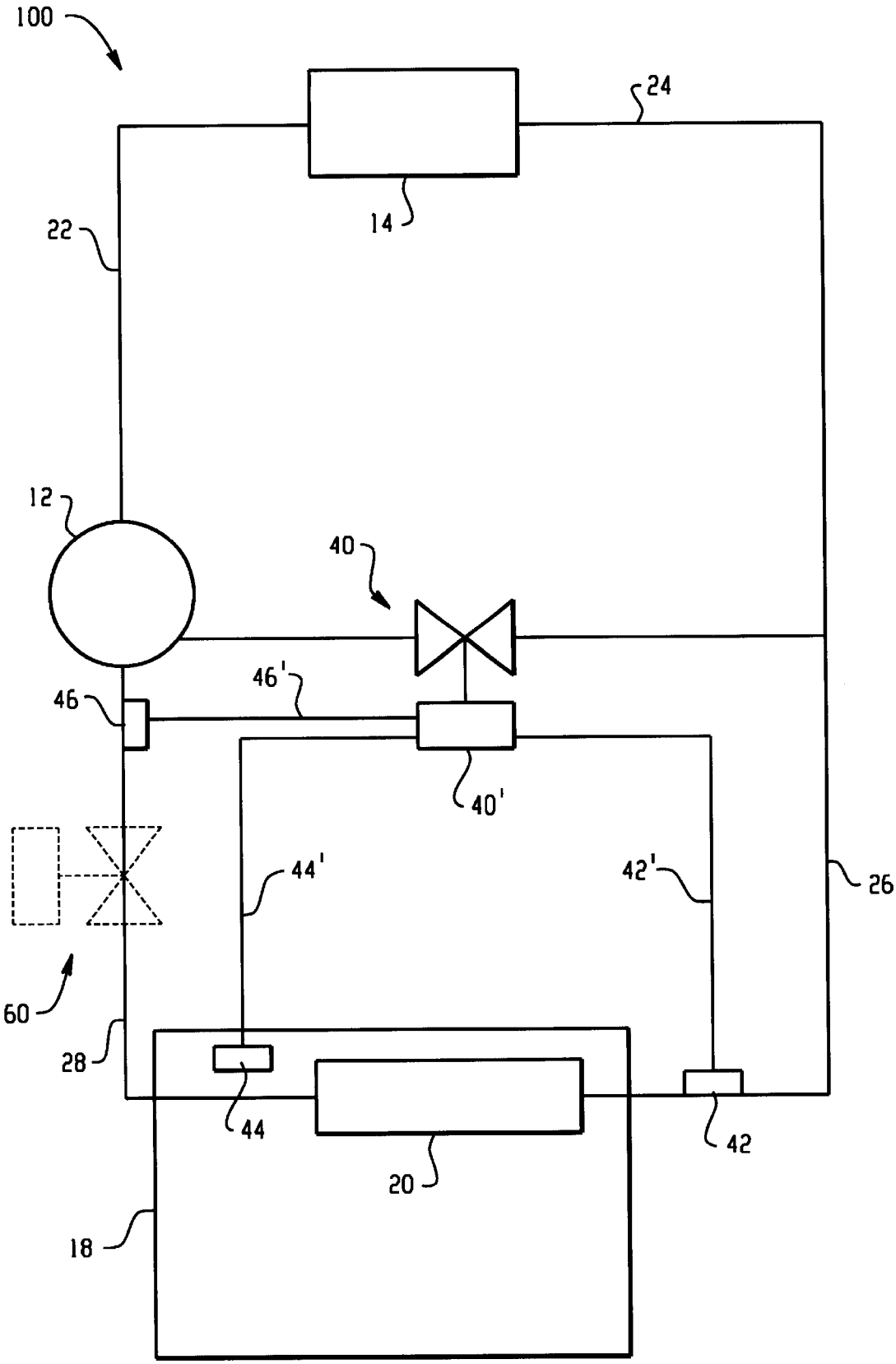
FIG. 2 is a schematic diagram of a refrigeration system without a subcooler in accordance with the present invention.

With reference to FIG. 2, a refrigeration system according to another preferred embodiment of the present invention is generally indicated by reference numeral 100. The components of the system 100 are generally the same as the components of the system 10 of the first preferred embodiment and, accordingly, like reference characters are used to represent like elements. Notably, the systems 10, 100 are substantially similar except that the subcooler 16 and its expansion valve 32 have been removed in the embodiment of FIG. 2.

Without the subcooler 16 and the expansion valve 32, bleed line 30 and return line 36 (FIG. 1) are replaced by a single line 102 (FIG. 2) disposed in parallel relation with the evaporator 20. The modulating evaporator pressure regulator valve is disposed on the single line 102. As described in detail above, the modulating valve selectively controls suction gas pressure of the compressor 12 and thereby controls the liquid temperature of the refrigerant entering the evaporator 20. Again, modulation occurs in response the dew point of the store as measured by sensor 42, and possible in conjunction with one or more of the temperature of the refrigerator case as measured by sensor 44, the temperature of the refrigerant returning to the compressor as monitored by sensor 46, or the subcooler sensor 48. Modulating the flow of refrigerant allows the system 100 to efficiently cool the refrigeration cases 18 to a desired temperature while preventing line sweating in line 26 connected to the evaporator 20.

Alternative sensors and measurements can be used as described above. Again, one skilled in the art will appreciate that the valve 40 can modulate in response to any combination of measurements taken by the above disclosed sensors 42–46 and the number of sensors used and the precise location of the sensors may vary. All such combinations and locations are to be considered within the scope of the present invention.

As in the preferred embodiment of FIG. 1, the location of the modulating valve 40 in the system 100 may be varied. The modulating valve 60 can alternatively be positioned in the line 28 between the evaporator 20 and the compressor 12. In this alternate arrangement, the modulating valve 60 continues to selectively control the suction gas pressure to the compressor 12 thereby controlling the liquid temperature of the refrigerant entering the evaporator 20. The sensors are used in the same manner as described previously.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. A refrigeration system comprising:

a compressor;

a condenser;

refrigeration case;

an evaporator for cooling the refrigeration case;

the compressor interconnected to the condenser, the condenser interconnected to the evaporator, and the evaporator interconnected to the compressor in a closed loop; and a modulating evaporator pressure regulator valve disposed in parallel relation with the evaporator, wherein the modulating evaporator pressure regulator valve modulates the flow of refrigerant in response to dew point of a store surrounding a line entering the evaporators to efficiently cool the refrigeration case to a desired temperature while preventing line sweating.

2. The refrigeration system of claim 1 wherein a subcooler is operatively disposed downstream of the condenser and upstream of the evaporator, the subcooler including an expansion valve for expanding a first portion of the condensed refrigerant exiting the condenser and using the expanded refrigerant for subcooling a second portion of remaining unexpanded refrigerant exiting the condenser, the unexpanded refrigerant flowing to the evaporator after subcooling, the subcooler having a return line in parallel with the evaporator for returning the expanded refrigerant to the compressor after subcooling, the modulating evaporator pressure regulator valve located at one of between the evaporator and the subcooler, and in parallel with the evaporator on the return line between the subcooler and the compressor.

3. The refrigeration system of claim 2 wherein the modulating evaporator pressure regulator valve selectively controls suction gas pressure of the compressor and thereby controls liquid temperature of the refrigerant entering the evaporator.

4. The refrigeration system of claim 1 wherein the modulating evaporator pressure regulator valve selectively controls suction gas pressure of the compressor and thereby controls liquid temperature of the refrigerant entering the evaporators.

5. The refrigeration system of claim 1 further comprising lines for interconnecting the compressor, condenser, evaporation, and refrigeration case, wherein lines leading to the refrigeration case are not insulated.

6. The refrigeration system of claim 1 wherein the modulating evaporator pressure regulator valve modulates the flow rate of refrigerant according to the temperature of the refrigerant returning to the compressor.

7. The refrigeration system of claim 1 wherein the modulating evaporator pressure regulator valve modulates the flow rate of refrigerant according to the suction gas going through the liquid subcooler.

8. A refrigeration system comprising:

a compressor;

a condenser;

an evaporator for cooling one or more refrigeration cases;

fluid passages interconnecting in series in a closed loop the compressor to the condenser, the condenser to the evaporator, and the evaporator to the compressor;

a subcooler operatively disposed between the condenser and the evaporator, the subcooler including an expansion valve for expanding a portion of condensed refrigerant exiting the condenser and using the expanded refrigerant portion for subcooling a remaining unexpanded liquid refrigerant exiting the condenser, the unexpanded refrigerant flowing to the evaporator after subcooling, the subcooler returning the expanded refrigerant to the compressor after subcooling; and a modulating evaporator pressure regulator valve interposed between the subcooler and the compressor, wherein the modulating evaporator pressure regulator valve modulates the flow rate of the refrigerant according to a dew point of ambient air surrounding the line.

9. The refrigeration system of claim 8 wherein the modulating evaporator pressure regulator valve modulates to decrease the flow rate of the refrigerant to the compressor which results in warmer refrigerant entering the evaporators.

10. The refrigeration system of claim 9 wherein a line leading to the refrigeration cases is not insulated.

11. The refrigeration system of claim 8 wherein the modulating evaporator pressure regulator valve modulates the flow rate of refrigerant according to a temperature in the refrigeration cases.

12. The refrigeration system of claim 8 wherein the modulating evaporator pressure regulator valve modulates the flow rate of refrigerant according to a temperature of the refrigerant returning to the compressor.

13. The refrigeration system of claim 8 wherein the modulating evaporator pressure regulator valve modulates the flow rate of refrigerant according to the suction gas going through the liquid subcooler.

14. An air cooling system for a commercial refrigeration cases, the system comprising:

a compressor;

a condenser;

one or more evaporators for cooling one or more refrigeration cases;

a line for a refrigerant interconnecting in series in a closed loop the compressor to the condenser, the condenser to the evaporator, and the evaporator to the compressor;

a subcooler operatively disposed between the condenser and the evaporators, the subcooler including an expansion valve for normally expanding a portion of the condensed refrigerant exiting the condenser and using the expanded refrigerant for subcooling the remaining unexpanded liquid refrigerant exiting the condenser, the unexpanded refrigerant flowing to the evaporators after subcooling, the subcooler having a return line for returning the expanded refrigerant to the compressor after subcooling; and a modulating evaporator pressure regulator valve disposed on the return line, the modulating evaporator, the modulating evaporator pressure regulator valve modulating suction gas pressure to the compressor which controls the liquid temperature of the refrigerant entering the evaporators, the modulation dependent on ambient environment dew point of the line entering the evaporators.

* * * * *

UNITED STATES PATENT AND TRADEMARK OFFICE

CERTIFICATE OF CORRECTION

PATENT NO. : 6,446,540 B1 
DATED : September 10, 2002
INVENTOR(S) : Ota et al.

It is certified that error appears in the above-identified patent and that said Letters Patent is hereby corrected as shown below:

Column 6,
Line 30, please delete “boss, and outer” and insert therefor -- boss, an outer --.

Signed and Sealed this

Twenty-fifth Day of February, 2003

JAMES E. ROGAN
*Director of the United States Patent and Trademark Office*